US006349621B1

(12) United States Patent
Khachatoorain

(10) Patent No.: US 6,349,621 B1
(45) Date of Patent: Feb. 26, 2002

(54) WRENCH

(75) Inventor: Zareh Khachatoorain, Northridge, CA (US)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 09/499,797

(22) Filed: Feb. 8, 2000

(51) Int. Cl.[7] ..... B25B 13/28
(52) U.S. Cl. ..... 81/99; 81/111
(58) Field of Search ..... 81/99, 111, 186

(56) References Cited

U.S. PATENT DOCUMENTS

| | | | | |
|---|---|---|---|---|
| 262,840 A | | 8/1882 | Simmons et al. | |
| 343,038 A | | 6/1886 | Langstrom | |
| 676,318 A | | 6/1901 | Jackson | |
| 739,316 A | | 9/1903 | Irland | |
| 800,850 A | | 10/1905 | Irland | |
| 831,750 A | | 9/1906 | Smith | |
| 868,126 A | | 10/1907 | Richards et al. | |
| 868,127 A | | 10/1907 | Richards | |
| 874,545 A | | 12/1907 | Scribner | |
| 897,665 A | | 9/1908 | De Leonard Rugg | |
| 937,959 A | | 10/1909 | Richards | |
| 970,731 A | | 9/1910 | Melchert | |
| 1,576,918 A | | 3/1926 | Lidell | |
| 1,627,035 A | | 5/1927 | Jahn | |
| 1,634,908 A | | 7/1927 | Lynch et al. | |
| 1,885,616 A | | 11/1932 | Mead | |
| 2,028,406 A | | 1/1936 | Mead | |
| 2,154,531 A | * | 4/1939 | Roche | 81/186 |
| 2,417,085 A | | 3/1947 | Mullinix | |
| 2,467,658 A | | 4/1949 | Carnelli | |
| 2,618,996 A | | 11/1952 | Logan | |
| 2,623,428 A | | 12/1952 | Larson | |
| 2,655,064 A | | 10/1953 | Simon et al. | |
| 2,684,607 A | | 7/1954 | Lundell | |
| D287,928 S | | 1/1987 | Watanabe | |
| 4,651,597 A | | 3/1987 | Yang | |
| 4,718,315 A | | 1/1988 | Nitschmann | |
| 4,773,287 A | | 9/1988 | Clarke | |
| 5,251,518 A | * | 10/1993 | Woo | 81/99 |
| 5,582,083 A | * | 12/1996 | Baker | 81/186 X |
| 5,746,097 A | | 5/1998 | McCann | |

FOREIGN PATENT DOCUMENTS

| | | |
|---|---|---|
| GB | 333103 | 8/1930 |

OTHER PUBLICATIONS

"The Smart Tools for the Smart Users", *Hardwares*, Aug. 1999, p. 125.
*Best Fortune*, Aug. 1999 catalog, No. BF–003, pp. 3–4 and 15.
"Multi–Purpose Speed Wrench", catalog, Ken Shen Co., Ltd. of Taiwan, one page (no date).
Catalog, Chang Loon Industrial Co. Ltd, Taiwan, one page (no date).

* cited by examiner

*Primary Examiner*—James G. Smith
(74) *Attorney, Agent, or Firm*—Lackenbach Siegel Marzullo Aronson & Greenspan, P.C.

(57) ABSTRACT

A wrench for applying a force to a work piece comprises a handle having proximal and distal ends, top and bottom edges and a slot extending therethrough with a groove extending downward from the slot. A fixed jaw is mounted at the distal end of the handle having an inner, contact surface for contacting the work piece, and a moveable jaw is pivotally mounted at the distal end of the handle having an inner, contact surface for contacting the work piece. A spring is mounted in the handle having a distal end in contact with the moveablejaw for biasing the moveable jaw toward the fixed jaw. A slidable button is mounted on the top edge of the handle, with a spring mounted between the slidable button and the top edge of the handle. A connector is provided having a distal end fixedly attached to the moveable jaw and a proximal end fixedly attached to the slidable button by a pin. In operation, the pin rides in the slot and fits in the groove.

23 Claims, 4 Drawing Sheets

WRENCH

FIELD OF THE INVENTION

The present invention is directed to a wrench, and more particularly to a wrench having a locking mechanism for holding open the jaws of the wrench for easy removal of a workpiece from the jaws.

BACKGROUND OF THE INVENTION

Previously, adjustable wrenches have been provided with a moveable jaw that permits use of the wrench with work pieces, e.g., pipes and nuts, of varying sizes. However, once the jaws of the wrench are closed on the work piece, the work piece can be removed only by manually opening the moveable jaw away from the work piece. Attempts have been made to provide wrenches where the user can open the moveable jaw without actually grasping and pulling the moveable jaw. However, in many such designs, a significant amount of force must nonetheless be exerted by the user to open the jaw.

SUMMARY OF THE INVENTION

The present invention is directed to an improved wrench having a moveable jaw whereby minimal force is necessary to open the moveable jaw to remove the work piece. In one embodiment, the invention is directed to a wrench for applying a force to a work piece comprising a handle having proximal and distal ends and top and bottom surfaces. A fixed jaw is mounted at the distal end of the handle, and a moveable jaw is pivotally mounted at the distal end of the handle. A biasing means is mounted in the handle for biasing the moveable jaw toward the fixed jaw. A slidable button is mounted on the top surface of the handle. A connector is provided having a distal end fixedly attached to the moveable jaw and a proximal end fixedly attached to the slidable button. The wrench further comprises means for locking the slidable button in a fixed position to hold the moveable jaw in an open position.

In a preferred embodiment, the invention is directed to a wrench having a handle and fixed and moveable jaws, as described above. The handle has a slot extending therethrough with at least one groove extending downward from the slot. A spring is mounted in the handle having a distal end in contact with the moveable jaw for biasing the moveable jaw toward the fixed jaw. A slidable button is mounted on the top surface of the handle, with a spring mounted between the slidable button and the top surface of the handle. The wrench further comprises a connector having a distal end fixedly attached to the movable jaw and a proximal end fixedly attached to the slidable button by a pin. In operation, the pin rides in the slot and fits in the groove.

By the above designs, when the user desires to remove the wrench from the work piece, he pushes the wrench distally toward the work piece. The work piece exerts a force on the proximal end of the moveable jaw, counteracting the biasing force of the spring and thereby opening the jaw. When the jaw opens, the connector is moved proximally, thus moving the slidable button proximally. This movement causes the pin to move proximally within the slot. When the moveable jaw is opened far enough for the work piece to be removed, the user pushes downward on the slidable button, thereby holding open the moveable jaw. Further, in the preferred embodiment, pushing on the slidable button forces the pin into the groove, further locking the moveable jaw in an open position so that, even if the user releases the slidable button, the moveable jaw will remain open.

DESCRIPTION OF THE DRAWINGS

These and other features of the advantages of the present invention will be better understood by reference to the following detailed description when considered in conjunction with the accompanying drawings wherein.

DETAILED DESCRIPTION

Figure 1:
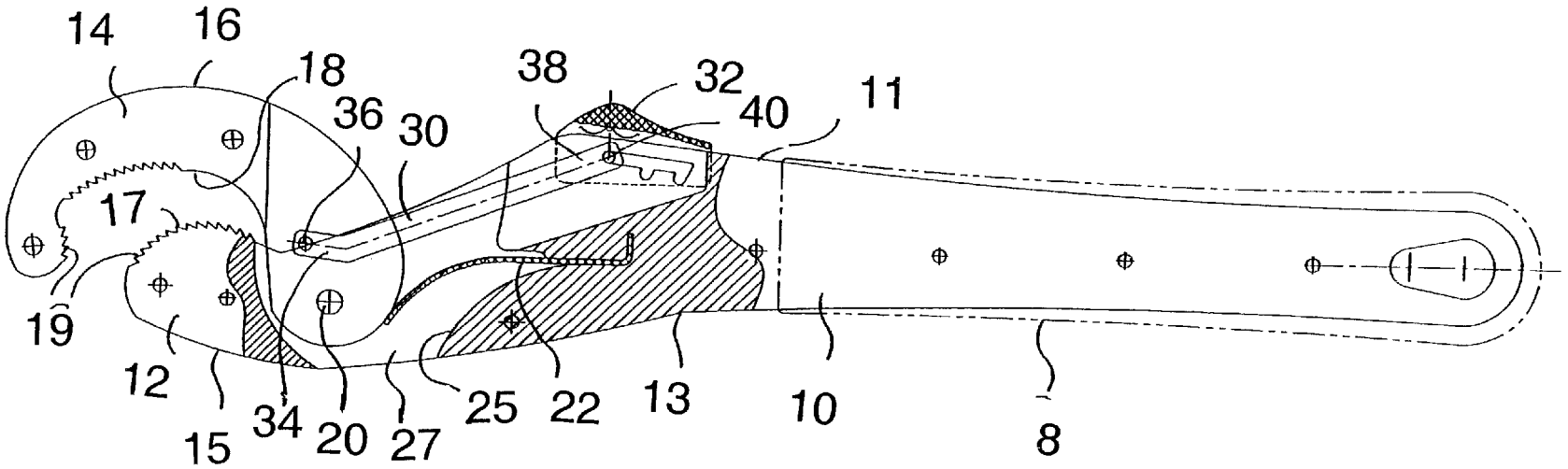
FIG. 1 is a side, partial cross-sectional view of a pipe wrench according to the invention.

The present invention is directed to a pipe wrench or other multi-purpose wrench having a locking mechanism for holding the jaws open during use. As shown in FIG. 1, the pipe wrench comprises a handle 10 having a top surface 11 and a bottom surface 13 and fixed and moveable jaws 12 and 14 at the distal end of the handle. The fixed and movable jaws each have an outer surface 15 and 16 and an inner, contact surface 17 and 18 for contacting a pipe or other work surface. The jaws are mounted such that the outer surface 16 of the moveable jaw 14 corresponds to the top surface 11 of the handle and the outer surface 15 of the fixed jaw 12 corresponds to the bottom surface 13 of the handle. Teeth 19 are provided on the contact surfaces 17 and 18 to increase the friction between the contact surfaces and the pipe or other work surface. As would be recognized by one skilled in the art, the contact surfaces 17 and 18 can be smooth without teeth.

In the depicted embodiment, the fixed jaw 12 is unitary with the handle 10, although the fixed jaw can also be a separate piece fixedly attached to the handle, as would be recognized by one skilled in the art. Further, a plastic grip 8 or other cover is provided over the proximal end of the handle 10 for comfort.

Figure 2:
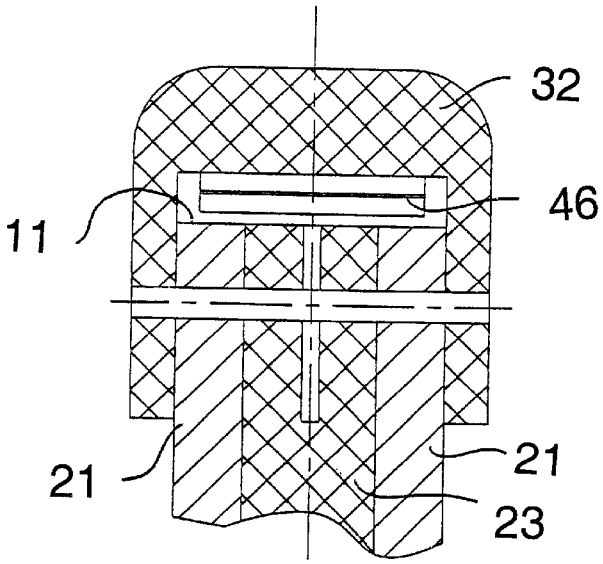
FIG. 2 is an end cross-sectional view of the slidable knob mounted on the handle of the pipe wrench.

In a preferred embodiment, the handle 10 and fixed jaw 12 are formed a plurality of laminated layers 21 of cold rolled sheet metal steel with a plastic filler layer 23 between the laminated layers over a portion of the length of the handle, as shown in FIGS. 1 and 2. The number of laminated layers is selected to achieve the desired thickness of the wrench so that the wrench can accommodate a desired load. For example, in the depicted embodiment, the plastic filler layer 23 has a thickness of approximately 0.31 inch (7.8 mm) and the laminated layers 21 on either side of the filler layer each have a total thickness of approximately 0.12 inch (3.0 mm) so that the handle has a total thickness of about 0.54 inch (13.8 mm).

Figure 3:
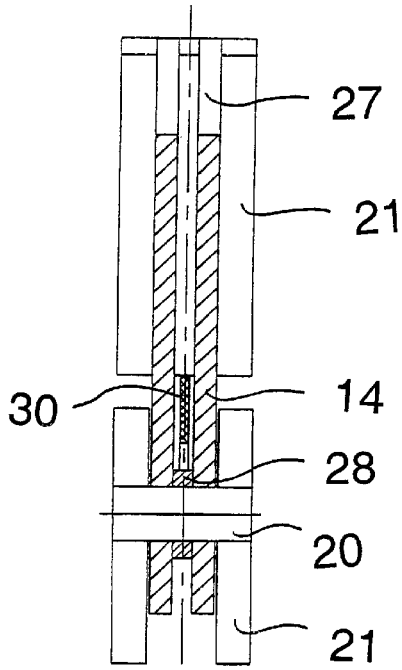
FIG. 3 is an end cross-sectional view of the joint of the movable jaw with the handle of the pipe wrench.

The moveable jaw 14 is rotatably mounted to the handle 10 by a pin 20 or any other suitable means, such as a screw, as shown in FIGS. 1 and 3. As best shown in FIG. 1, the plastic filler layer 23 terminates a portion of the way along the length of the handle at line 25. A space 27 is provided between the laminated layers 21 to accommodate the proximal end of the moveable jaw 14 as the jaw opens and closes, as described in more detail below. If desired, a washer and/or spacer 28 is provided near the pin 20 to enhance the free movement of the moveable jaw 14. In use, when the wrench is in a neutral position, the contact surface 18 of the moveable jaw 14 is in contact with the contact surface 17 of the fixed jaw 12, forming a contact region. As the wrench is pushed against a pipe or other work surface, such that the distal end of the contact region is in contact with the pipe, the force of the pipe against the contact region opens the jaws such that the pipe moves between the jaws. Once the pipe is between the jaws, the force of the spring 22 on the moveable jaw 14 biases the moveable jaw toward the pipe. The user can then turn the pipe by turning the handle 10 of the wrench.

A spring 22 is provided in the handle 10 for biasing the moveable jaw 14 toward the fixed jaw 12. The spring 22 is generally L-shaped, having a distal end 24 in contact with the moveable jaw 14 and a proximal end fixedly attached to the handle 10. As would be recognized by one skilled in the art, any other biasing means capable of biasing the moveable jaw toward the fixed jaw could also be used, such as a spring having a shape different from the depicted embodiment.

When the user desires to remove the wrench from the pipe, he or she pushes the wrench distally toward the pipe. The pipe exerts a force on the proximal end of the contact surface 18 of the moveable jaw 14, counteracting the force of the spring and thereby opening the jaw.

In use, when the wrench is in a neutral position, the contact edge 18 of the moveable jaw 14 is in contact with the contact edge 17 of the fixed jaw 12, forming a contact region. As the wrench is pushed against a pipe or other work surface, such that the distal end of the contact region is in contact with the pipe, the force of the pipe against the contact region opens the jaws such that the pipe moves between the jaws. Once the pipe is between the jaws, the force of the spring 22 on the moveable jaw 14 biases the moveable jaw toward the pipe. The user can then turn the pipe by turning the handle 10 of the wrench.

When the user desires to remove the wrench from the pipe, he pushes the wrench distally toward the pipe. The pipe exerts a force on the proximal end of the contact edge 18 of the moveable jaw 14, counteracting the force of the spring and thereby opening the jaw.

To hold the moveable jaw 14 open so that the user can pull the wrench proximally away from the pipe without the moveable jaw closing on the pipe, a locking mechanism is provided. The locking mechanism comprises a lever 30 (or other connector) extending through the handle 10, a slidable button 32 slidably mounted on the top edge 11 of the handle, and means for locking the slidable button in a fixed position to hold the moveablejaw in an open position. As used herein, the term "open position" refers to the position that the moveable jaw is in when a pipe or other work piece can be removed from between the moveable jaw and fixed jaw.

In the depicted embodiment, the lever 30 is bent, although, as would be recognized by one skilled in the art, the lever can also be straight. As shown in FIGS. 1 and 2, a spring 46 is provided between the button 32 and the top edge 11 of the handle 10. The lever 30 has a distal end 34 fixedly attached to the moveable jaw 14, preferably the proximal end of the moveable jaw, by a distal pin 36 or the like. The lever 30 has a proximal end 38 fixedly attached to the slidable button 32 by means of a proximal pin 40.

The proximal pin 40 rides in a slot 42 in the handle, preferably a longitudinal slot. As used herein, the term "longitudinal" in relation to the slot means that the slot has a proximal end and a distal end and extends generally along a portion of the length of the handle. Alternatively, the lever 30 can be connected to the slidable button 32 by any other suitable means, such as glue, weld, solder, a screw or the like, and a separate pin or other means for riding in the slot 42 is fixedly attached to the slidable button. For example, However, in a preferred embodiment, the means for connecting the lever 30 to the slidable button 32 is the same as the means for riding in the slot 42.

Figure 4:
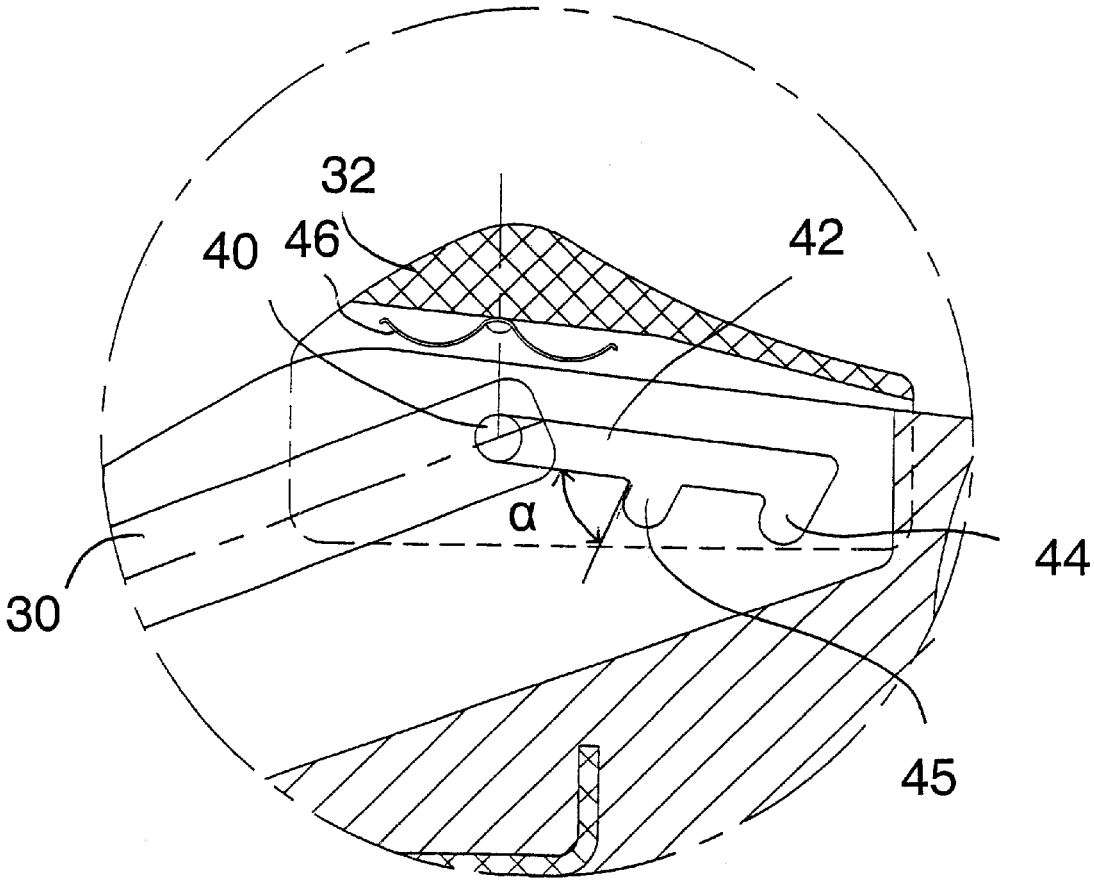
FIG. 4 is an enlarged view of the slidable knob depicted in FIG. 1.

The slot 42 is generally parallel with the top edge 11 of the handle 10 along which the slidable button 32 moves. Proximal and distal grooves 44 and 45 extend downward (i.e., away from the top edge 11) from the slot 42. The grooves 44 and 45 are each provided at an angle $\alpha$ relative to the slot, as shown in FIG. 4, less than 90°, preferably ranging from about 60° to about 85°, more preferably between about 65° to 80°, still more preferably about 70°. Alternatively, the grooves can extend upward from the slot at an angle.

In use, as the pipe or other work surface is forced against the proximal end of the contact edge 18 of the moveable jaw 14, opening the jaw, the lever 30 moves proximally. Proximal movement of the lever 30 moves the proximal pin 40 proximally within the slot 42, and the slidable button 32 correspondingly moves proximally along the top edge 11 of the handle 10. As would be recognized by one skilled in the art, the lever 30 could be replaced with any other rigid connector capable of translating movement of the moveable jaw 14 to the proximal pin 40 and slidable button 32. When the moveable jaw 14 is opened far enough for the pipe to be removed, the user pushes downward on the slidable button 32, thereby forcing the proximal pin 40 into one of the grooves 44 and 45 and locking the moveable jaw 14 in an open position. For smaller pipes, the proximal pin is forced into the distal groove 45, and for larger pipes, the proximal pin is forced into the proximal groove 44. The user can then remove the wrench from the pipe without the moveable jaw 14 closing back onto the pipe. As a result, the user need not directly exert a proximal force on the slidable button 32 by pulling the button proximally, which can be difficult depending on the size of the pipe, but can indirectly exert a proximal force on the button by pushing the wrench distally toward the pipe.

As would be recognized by one skilled in the art, the number of grooves can vary as desired. For example, only one groove can be provided, or three or more grooves can be provided. Alternatively, no grooves can be provided, in which case the user can lock the moveable jaw 14 in place, once open, by holding the slidable button 32 in place. Even with this alternative design, it is unnecessary for the user to exert a direct proximal force on the moveable jaw with the button, but only for the user to hold the button in place once he indirectly exerts the force, as described above.

Figure 5:
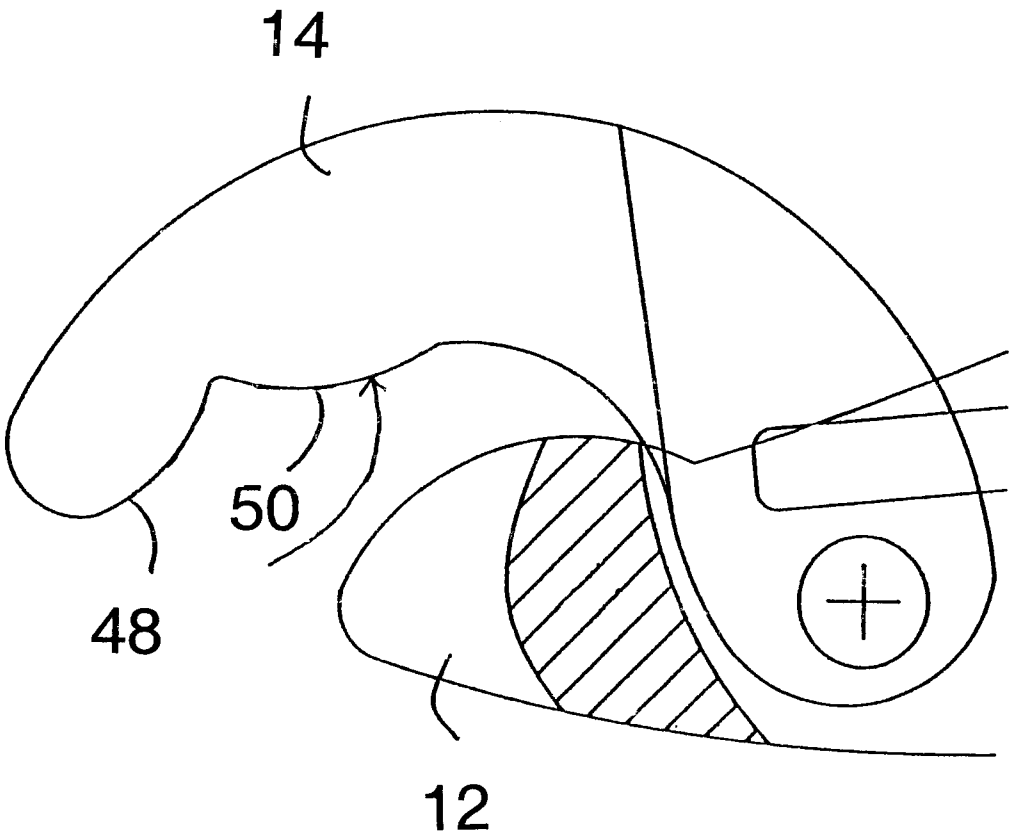
FIG. 5 is a side view Oman alternative jaw arrangement for a multi-purpose wrench according to the invention.

In a particularly preferred embodiment, the inner contact edge 18 of the moveable jaw 14 comprises at least two curved edges 48 and 50, as shown in FIG. 5. The two curved edges enhance the ability of the jaws 12 and 14 to close tightly upon the workpiece and hold it in place. The distal curved edge 48 preferably has a radius of curvature ranging from about 0.38 inch to about 0.52 inch, more preferably about 0.42 inch to about 0.48 inch, still more preferably about 0.46 inch. The proximal curved edge 50 preferably has a radius of curvature ranging from about 0.50 inch to about 0.70 inch, more preferably from about 0.56 inch to about 0.64 inch, still more preferably about 0.60 inch. In the depicted embodiment, the fixed jaw 12 has an inner contact edge 17 having a distal curved edge 52 that preferably has a radius of curvature ranging from about 0.55 inch to about 0.75 inch, preferably about 0.64 inch.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A wrench for applying a force to a work piece, the wrench comprising:

a handle having proximal and distal ends and top and bottom surfaces;

a fixed jaw mounted at the distal end of the handle having an inner, contact surface for contacting the work piece;

a moveable jaw pivotally mounted at the distal end of the handle having an inner, contact surface for contacting the work piece;

a biasing means mounted in the handle for biasing the moveable jaw toward the fixed jaw;

a slidable button mounted on the top surface of the handle;

a connector having a distal end fixedly attached to the moveable jaw and a proximal end fixedly attached to the slidable button; and means for locking the slidable button in a fixed position to hold the moveable jaw in an open position.

2. A wrench according to claim 1, further comprising a spring mounted between the slidable button and the top surface of the handle.

3. A wrench according to claim 1, wherein the means for locking the slidable button comprises a longitudinal slot extending through the handle and a means for riding in the slot fixedly attached to the slidable button.

4. A wrench according to claim 1, wherein the means for locking the slidable button comprises a slot extending through the handle and generally parallel to the top surface of the handle and a means for riding in the slot fixedly attached to the slidable button.

5. A wrench according to claim 3, wherein the slot has at least one groove extending therefrom.

6. A wrench according to claim 5, wherein the groove is at an angle $\alpha$ relative to the slot less than 90°.

7. A wrench according to claim 5, wherein the groove is at an angle $\alpha$ relative to the slot ranging from about 60° to about 85°.

8. A wrench according to claim 6, wherein the groove extends downward from the slot.

9. A wrench according to claim 7, wherein the groove is at an angle $\alpha$ relative to the slot ranging from about 60° to about 85°.

10. A wrench according to claim 3, wherein the slot has two grooves extending downward therefrom.

11. A wrench according to claim 3, wherein the means for riding in the slot is fixedly attached to the connector.

12. A wrench according to claim 3, wherein the means for riding in the slot comprises a pin fixedly attached to the connector and to the slidable button.

13. A wrench for applying a force to a work piece, the wrench comprising:

a handle having proximal and distal ends, top and bottom surfaces and a slot extending therethrough;

a fixed jaw mounted at the distal end of the handle having an inner, contact surface for contacting the work piece;

a moveable jaw pivotally mounted at the distal end of the handle having an inner, contact surface for contacting the work piece;

a biasing means mounted in the handle for biasing the moveable jaw toward the fixed jaw;

a slidable button mounted on the top surface of the handle;

a connector having a distal end fixedly attached to the moveable jaw and a proximal end fixedly attached to the slidable button; and means for riding in the slot connected to the slidable button.

14. A wrench according to claim 13, wherein the means for riding in the slot comprises a pin.

15. A wrench according to claim 13, wherein the means for riding in the slot is a pin attached to the connector.

16. A wrench according to claim 13, wherein the biasing means comprises a spring.

17. A wrench according to claim 13, wherein the biasing means comprises a generally L-shaped spring.

18. A wrench according to claim 13, further comprising a spring mounted between the slidable button and the top surface of the wrench.

19. A wrench according to claim 13, wherein the slot has at least one groove extending therefrom.

20. A wrench according to claim 19, wherein the groove extends downward and is at an angle $\alpha$ relative to the slot less than 90°.

21. A wrench according to claim 19, wherein the groove extends downward and is at an angle $\alpha$ relative to the slot ranging from about 60° to about 85°.

22. A wrench according to claim 13, wherein the slot has two grooves extending downward therefrom.

23. A wrench for applying a force to a work piece, the wrench comprising:

a handle having proximal and distal ends, top and bottom surfaces and a slot extending therethrough with a groove extending downward from the slot;

a fixed jaw mounted at the distal end of the handle having an inner, contact surface for contacting the work piece;

a moveable jaw pivotally mounted at the distal end of the handle having an inner, contact surface for contacting the work piece;

a spring mounted in the handle having a distal end in contact with the moveable jaw for biasing the moveable jaw toward the fixed jaw;

a slidable button mounted on the top surface of the handle;

a spring mounted between the slidable button and the top surface of the handle;

a connector having a distal end fixedly attached to the moveable jaw and a proximal end fixedly attached to the slidable button by a pin, wherein, in operation, the pin rides in the slot and fits in the groove.

* * * * *